US006686324B2

(12) United States Patent
Ramirez et al.

(10) Patent No.: US 6,686,324 B2
(45) Date of Patent: Feb. 3, 2004

(54) LOW-FOAMING HYDROGEN PEROXIDE CLEANING SOLUTION FOR ORGANIC SOILS

(75) Inventors: Jose A. Ramirez, Mississauga (CA); Nancy M. A. Sullivan, Toronto (CA)

(73) Assignee: Virox Technologies, Inc., Mississauga (CA)

( * ) Notice: Subject to any disclaimer, the term of this patent is extended or adjusted under 35 U.S.C. 154(b) by 0 days.

(21) Appl. No.: 10/193,182

(22) Filed: Jul. 12, 2002

(65) Prior Publication Data

US 2003/0078178 A1 Apr. 24, 2003

Related U.S. Application Data

(63) Continuation-in-part of application No. 09/718,701, filed on Nov. 22, 2000, now abandoned.
(60) Provisional application No. 60/167,631, filed on Nov. 26, 1999.

(51) Int. Cl.[7] ..... C11D 1/22; C11D 3/395
(52) U.S. Cl. ..... 510/218; 510/234; 510/302; 510/367; 510/372; 510/375; 510/378; 510/426; 510/436; 510/477; 510/480; 510/536
(58) Field of Search ..... 510/218, 234, 510/302, 367, 372, 375, 378, 436, 426, 477, 480, 536

(56) References Cited

U.S. PATENT DOCUMENTS

| | | | | |
|---|---|---|---|---|
| 3,969,258 A | | 7/1976 | Carandang et al. | |
| 4,525,291 A | * | 6/1985 | Smith et al. | 252/95 |
| 4,525,292 A | * | 6/1985 | Cushman et al. | 252/102 |
| 4,878,951 A | | 11/1989 | Pochard et al. | |
| 5,149,463 A | * | 9/1992 | Peterson | 252/301.21 |
| 5,205,960 A | * | 4/1993 | Kristopeit et al. | 252/174.24 |
| 5,244,593 A | * | 9/1993 | Roselle et al. | 252/99 |
| 5,599,400 A | * | 2/1997 | Mao et al. | 134/25.2 |
| 5,602,090 A | | 2/1997 | Melikyan et al. | |
| 5,855,217 A | | 1/1999 | John | |
| 5,891,392 A | | 4/1999 | Monticello et al. | |
| 6,110,883 A | | 8/2000 | Petri et al. | |

FOREIGN PATENT DOCUMENTS

| | | |
|---|---|---|
| WO | WO 93/14183 | 7/1993 |
| WO | 98/59028 | * 12/1998 |
| WO | 99/02638 | * 1/1999 |

OTHER PUBLICATIONS

Parker & Litchfield, "Food Plant Sanitation" 1962, pp. 223–261.

* cited by examiner

*Primary Examiner*—Charles Boyer
(74) *Attorney, Agent, or Firm*—Clark & Brody

(57) ABSTRACT

A low-foaming cleaning solution and dry particulate formulation which can be diluted with water, deionized water, or mixtures thereof, to form the cleaning solution. The cleaning solution has an alkaline pH, which is preferably from about 8 to about 11.5 and consists essentially of at least one low foaming surfactant in a concentration of from about 0.005% to about 40% w/w of the total solution, at least one active oxygen releasing compound in an amount effective to produce a hydrogen peroxide concentration of from about 0.005% to about 50% w/w of the total solution, at least one builder in a concentration of from about 0.001% to about 50% w/w of the total solution, and at least one diluent selected from the group consisting of water, deionized water, and mixtures thereof. The at least one surfactant is selected from the group consisting of $C_3$–$C_8$ alkane sulfonates, $C_3$–$C_8$ alkyl sulfates, $C_1$–$C_7$ alkyl naphthalene sulfonates, polyoxyethylene/polyoxypropylene block copolymers having a polyoxypropylene molecular weight of from about 1500 to about 8500, of which less than about 30% of the total molecular weight is due to the polyoxyethylene portion, and mixtures thereof. The at least one active oxygen releasing compound is selected from the group consisting of hydrogen peroxide, at least one source of hydrogen peroxide, and mixtures thereof.

47 Claims, No Drawings

LOW-FOAMING HYDROGEN PEROXIDE CLEANING SOLUTION FOR ORGANIC SOILS

This application is a continuation-in-part of U.S. application Ser. No. 09/718,701 filed on Nov. 22, 2000 now abandoned, which application is entitled under 35 U.S.C. 119(e) to the benefit of U.S. provisional application No. 60/167,631, filed on Nov. 26, 1999.

FIELD OF THE INVENTION

The present invention relates to cleaning solutions and, more particularly, to low-foaming cleaning solutions for removing organic soils from hard surfaces.

BACKGROUND TO THE INVENTION

Low-foaming cleaning solutions useful in removing organic soils, including protein and glyceride-based deposits, are commonly used to clean equipment or utensils in the food processing, dairy, health care, dental and veterinary industries. Equipment used in the food and dairy industries are often cleaned "in-place" by circulating a cleaning solution repeatedly through liquid-carrying pipes of the equipment. In the cleaning of medical, veterinary and dental utensils, items are enclosed in a washing chamber of a washing machine and sprayed with a wash solution which is collected from the washing chamber and recirculated to be sprayed again onto the utensils. This cycle repeats continuously for a predetermined period of time or number of cycles. Foam buildup is objectionable in the above circumstances as it will increase the amount of entrapped air in the recirculating solution. This results in cavitation at the pump or in the recirculating pump losing its prime.

Known low-foaming cleaning solutions include chlorine-based cleaners of high alkalinity, or formulations containing one or more enzymes in a basic solution. Chlorine-based cleaners and enzyme-based cleaners work by breaking large protein, linked amino-acid, glyceride or fatty acid molecules through oxidation and enzymatic action, respectively. The chlorine-based cleaners are based on the high oxidative power of chlorine in combination with an alkaline medium to reduce these large soil particles to smaller units easily dissolved or emulsified by the surface active species present. Similarly, enzymatic cleaners rely on high alkalinity and the chemical breakdown of peptide bonds in proteins for dissolution of soils. In both cases, alkaline conditions result in saponification of fats in the soil, further contributing to the detergency process. Though the actual mechanisms for removing soils differ in both types of cleaning solutions, the effects are similar, namely, large particles are broken down into smaller more water soluble units that are eventually dissolved in the wash liquor.

Drawbacks of chlorine-based cleaners are that their use produces large amounts of waste water containing high amounts of free chlorine. Furthermore, these cleaners are hazardous if mixed with acid solutions (commonly used in two-step cleaning/sanitizing procedures in certain applications) to produce highly poisonous chlorine gas. Also, these cleaners tend to have very pungent odors, may cause skin and eye irritations, and may permanently damage the substrates to which they are applied.

Enzyme-based cleaners, although quite effective in combating protein and lipid-based soils, generally require high temperatures for effective cleaning. Furthermore, the cost of enzyme-based compositions is considerably higher than the cost of most cleaning chemicals. As a consequence, the cost of cleaning with enzymatic-based compositions is generally prohibitive for large-scale applications, and is largely reserved for specialty applications in health, veterinary and dental care.

Hydrogen peroxide based cleaners have become favored more recently because they are odorless, non-corrosive at concentration levels typically employed for cleaning, safe to material substrates, their breakdown products (oxygen and water) are innocuous, and they can be made at low costs. However, the current art does not contemplate a low-foaming, cleaning solution containing hydrogen peroxide which would be useful in the applications discussed herein.

Until now, it has been necessary to add high detergency surfactants to boost the cleaning power of hydrogen peroxide based solutions, in order to achieve the same levels of cleaning efficiency as that of conventional hypochlorite and enzymatic cleaners. Surfactants (or surface active agents) work to decrease the interfacial tension in a solution to facilitate detachment and emulsification of soils. Unfortunately, surfactants which exhibit good detergency will also result in highly foaming solutions, whereas the use of non- or low-foaming surfactants generally leads to poor cleaning compositions. A common solution to this problem is to add silicone-based foam reducing agents to the wash solution. However, these materials tend to allocate and build up in difficult to reach places in the equipment and instruments which facilitates proliferation of microorganisms.

There is therefore a need for a low-foaming cleaning solution which is effective against organic-based soils, exhibits favorable environmental profiles, and possesses a minimal or no risk to the user or to the substrates being cleaned. The present invention is intended to, at least in part, meet these needs.

DESCRIPTION OF THE PRIOR ART

U.S. Pat. No. 3,969,258 to Carandang et al discloses an acidic, low-foaming sanitizing solution designed for use in recirculating systems in the food and milk industries. The solution is based on highly foaming anionic surfactants known for their antimicrobial properties, and foam suppressing agents consisting of a $C_8$–$C_{18}$ aliphatic alcohol, or a $C_9$–$C_{12}$ alkyl phenol, in combination with a polyvalent metal compound. The cleaning efficiency of the solution is not discussed and the use of hydrogen peroxide as a cleaning agent is not taught or suggested.

U.S. Pat. No. 4,878,951 to Pochard et al teaches alkaline cleaning formulations which are low foaming and therefore suitable for the cleaning in-place of equipment which circulates food or dairy products. The formulations contain a source of chlorine (e.g. hypochlorite) and a mixture of surfactants, one of which is a high-foaming $C_4$–$C_8$ alkylated diphenyl oxide sulfonate and the other of which is a nonionic surfactant which is stable in the formulation within certain concentration ranges and which acts to suppress foaming. The nonionic surfactant is selected from the group of polyoxyethylene/polyoxypropylene block copolymers and polyalkoxylated linear or branched aliphatic alcohols. The reported solutions are highly alkaline with caustic soda used at the rate of 10% w/w of the total solution composition. This reference does not disclose or suggest the use of alternate non-chlorine based oxidizers, such as hydrogen peroxide.

U.S. Pat. No. 5,855,217 to John describes a device, process and formulation for cleaning heavily soiled surfaces in the food industry. The device mixes a caustic detergent solution and an aqueous solution of hydrogen peroxide to form an unstable,.high foaming cleaning formulation which is ejected, under pressure, towards the surface to be cleaned before the hydrogen peroxide breaks down. The process is based on the generation of a cleaning foam containing hydrogen peroxide in an amount from 0.1% w/w to 1.0% w/w. The formulation taught clearly does not have application to recirculating systems where the presence of foam cannot be tolerated.

WO 93/14183 to the Procter & Gamble Company discloses a detergent composition which is stable and remains colorless over time. This is achieved by adding hydrogen peroxide and a metal sequestering agent to high detergency, high foaming anionic and/or nonionic surfactants. These surfactants do not include low-foaming small chain-alkane sulfonates and alkylarenesulfonates.

Numerous hydrogen-peroxide based cleaning compositions have been proposed, none of which appear suitable for applications involving substrates highly soiled with protein, carbohydrate and lipids, where both high detergency and low or no foaming are required. For example, U.S. Pat. No. 5,602,090 to Melikyan et al describes a hard surface cleaning solution comprising hydrogen peroxide, D-limonene, two anionic surfactants, a non-ionic surfactant, and deionized water. Although the low-foaming sodium 1-octane sulfonate (sold under the commercial name Bioterge PAS-8S) is listed as a possible one of the anionic surfactants, the other surfactant components are high-foaming.

U.S. Pat. No. 5,891,392 to Monticello et al teaches an acidic hard surface cleaning and disinfecting composition based on hydrogen peroxide as an active disinfecting constituent, a monohydric alcohol, a glycol ether or butoxypropanol or propoxypropanol, a nonionic surfactant, and an organic acid. All the non-ionic surfactants listed in this reference are high foaming.

U.S. Pat. No. 6,110,883 to Petri et al discloses a hydrogen peroxide-based composition suitable for use as a hard surface cleaner or in laundry applications. The composition further comprises a surfactant selected from a group of high detergency/foaming anionic, nonionic or amphoteric surfactants.

SUMMARY OF THE INVENTION

Formulations according to the present invention incorporate hydrogen peroxide and specific anionic surfactants which exhibit low-foaming properties. The formulations are designed for cleaning jobs where foam build up is objectionable and where the control of microbial populations is important. The invention provides both a liquid solution and a dry particulate formulation which may be diluted with water, deionized water, or a mixture thereof, to form the liquid solution. The solution may be in concentrated form for dilution by the end user or in ready-to-use diluted form.

Accordingly, in accordance with a first aspect, the invention provides a low-foaming cleaning solution having a pH of from about 8 to about 11.5, optionally, less than about 11, or less than about 9.5, and also optionally greater than about 9, and consisting essentially of:

a) at least one surfactant selected from the group consisting of $C_3$–$C_8$ alkane sulfonates, $C_3$–$C_8$ alkyl sulfates, $C_1$–$C_7$ alkyl naphthalene sulfonates, polyoxyethylene/polyoxypropylene block copolymers having a polyoxypropylene molecular weight of from about 1500 to about 8500, of which less than about 30% of the total molecular weight is due to the polyoxyethylene portion, and mixtures thereof, in a concentration of from about 0.005% to about 40% w/w of the total solution;

b) at least one active oxygen releasing compound selected from the group consisting of hydrogen peroxide, at least one source of hydrogen peroxide, and mixtures thereof, in an amount effective to produce a hydrogen peroxide concentration of from about 0.005% to about 50% w/w of the total solution;

c) at least one builder in a concentration of from about 0.001% to about 50% w/w, optionally greater than about 0.01% w/w of the total solution; and d) at least one diluent selected from the group consisting of water, deionized water, and mixtures thereof, to 100% w/w.

The source of hydrogen peroxide may be selected from the group consisting of percarbonate (e.g. sodium percarbonate), persilicate, persulphate, perborate (e.g. sodium perborate monohydrate and sodium perborate tetrahydrate), peroxyacids, dialkyl peroxides, diacyl peroxides, preformed percarboxylic acids, organic peroxides, inorganic peroxides, hydroperoxides, and mixtures thereof.

In one embodiment of the cleaning solution, the at least one surfactant is present in a concentration of from about 0.005% to about 4% w/w and may be less than about 3% w/w, the at least one active oxygen releasing compound is present in an amount effective to produce a hydrogen peroxide concentration of from about 0.005% to about 3% w/w, and the at least one builder is present in a concentration of from about 0.001% to about 11% w/w, all based on the total weight of the solution.

In another embodiment of the cleaning solution, the solution contains hydrogen peroxide in a concentration of from about 1% to about 20% w/w, the at least one builder is at least one cation sequestering agent present in a concentration of from about 0.5% to about 20% w/w, and the at least one surfactant is present in a concentration of from about 0.005% to about 3% w/w, all based on the total weight of the solution.

In yet another embodiment, the at least one surfactant is present in a concentration of from about 1.5% to about 4% w/w, the at least one active oxygen releasing compound is present in an amount effective to produce a hydrogen peroxide concentration of from about 2% to about 3% w/w, and the at least one builder is present in a concentration of from about 6% to about 11% w/w, all based on the total weight of the solution.

In a still further embodiment, the cleaning solution contains hydrogen peroxide in a concentration of from about 2% to about 7% w/w, the at least one builder is at least one cation sequestering agent present in a concentration of from about 0.5% to about 7% w/w, and the at least one surfactant is present in a concentration of from about 0.01% to about 2% w/w, all based on the total weight of the solution.

In another embodiment of the cleaning solution, the at least one surfactant is present in a concentration of from about 0.005% to about 0.03% w/w, the at least one active oxygen releasing compound is present in an amount effective to produce a hydrogen peroxide concentration of from about 0.005% to about 0.03% w/w, and the at least one builder is present in a concentration of from about 0.001% to about 0.10% w/w, all based on the total weight of the solution.

In a still further embodiment, the cleaning solution contains hydrogen peroxide in a concentration of from about 0.005% to about 2% w/w, preferably from about 0.01% to about 1% w/w, the at least one builder is at least one cation sequestering agent present in a concentration of from about 0.01% to about 2% w/w, preferably from about 0.01% to about 1% w/w, and the at least one surfactant is present in a concentration of from about 0.005% to about 3% w/w, preferably from about 0.01% to about 2% w/w, all based on the total weight of the solution.

The at least one surfactant may be selected from the group consisting of alkali metal and ammonium salts of octane sulfonic acid (e.g. sodium octyl sulfonate), alkali metal and ammonium salts of cumene, toluene, xylene sulfonic acids (e.g. sodium xylene sulfonate), a block copolymer consisting of a polyoxyethylene block capped at both ends by polyoxypropylene blocks where the total molecular weight of the polyoxypropylene portion is 1700 and the polyoxyethylene portion comprises about 20% of the total molecular weight, and mixtures thereof.

The at least one builder may be at least one cation sequestering agent selected from the group consisting of citric acid, glycolic acid, polyphosphates obtained by the thermal treatment of monosodium phosphate (e.g. tetrasodium pyrophosphate, sodium tripolyphosphate, sodium tetraphosphate, sodium hexametaphosphate, and mixtures thereof), amino phosphonic acid compounds with 1 to 5 phosphonic acid moieties (e.g. amino tri(methylene phosphonic acid), 1-hydroxyethylidene-1,1-diphosphonic acid, diethylenetriaminepenta (methylene phosphonic acid), ethylene diamine tetra(methylene phosphonic acid), and mixtures thereof), amino-carboxylic acid analogues of amino phosphonic acid compounds with 1 to 5 phosphonic acid moieties (e.g. ethylenediaminetetraacetic acid, diethylenetriaminepentaacetic acid, nitrilotriacetic acid, and mixtures thereof), and mixtures thereof.

The cleaning solution may contain at least one corrosion inhibitor for inhibiting corrosion of metallic substrates upon drying, in a concentration of from about 0.005% to about 5% w/w, preferably greater than about 0.01% w/w, and may be up to about 1.5% w/w, of the total solution. The at least one corrosion inhibitor may be selected from the group consisting of $C_2$–$C_5$ polyhydric alcohols (e.g. propylene glycol), triazoles, nitrites (e.g. sodium nitrite), molybdates (e.g. sodium molybdate), benzoates (e.g. 1,2,3-benzotriazole), gluconates, and mixtures thereof.

In accordance with a second aspect, the invention provides a dry particulate cleaning formulation which can be dissolved in water, deionized water, or a mixture thereof, to produce a cleaning solution according to the first aspect of the invention. The dry formulation contains at least one source of hydrogen peroxide which may be selected from the group consisting of sodium percarbonate, sodium perborate monohydrate, and sodium perborate tetrahydrate, and mixtures thereof, at least one builder, which may be a cationic sequestering agent, and at least one surfactant, which may be an anionic surfactant.

The concentration of each component required to provide a solution according to the first aspect of the invention will be readily apparent to the person skilled in the art. For example, in one embodiment, the at least one surfactant is present in an amount of from about 2% to about 20% w/w, the at least one source of hydrogen peroxide is present in an amount of from about 5% w/w to about 30% w/w, and the at least one builder is present in an amount of from about 5% to about 50% w/w, all based on the total weight of the formulation.

In another embodiment of the formulation, the at least one surfactant is present in an amount of from about 2% to about 10% w/w, the at least one source of hydrogen peroxide is present in an amount of from about 15% w/w to about 25% w/w, and the at least one builder is present in an amount of from about 10% to about 20% w/w, all based on the total weight of the formulation.

In other embodiments of the formulation, at least one source of hydrogen peroxide is present in an amount effective to produce a hydrogen peroxide concentration of from about 5% w/w to about 30% w/w, or about 15% w/w to about 25% w/w, when the formulation is dissolved to form an aqueous solution.

The formulation may contain, for every one part by weight of the at least one source of hydrogen peroxide, from about 0.25 to about 4 parts by weight of the at least one builder.

Optionally, the formulation may contain a diluent in the form of at least one inert filler selected from the group consisting of sulfate salts, phosphate salts, silicate salts, carbonate salts, and mixtures thereof.

Liquid cleaning solutions and particulate cleaning formulations according to the invention may be contain at least one buffer in an amount effective to achieve the desired alkaline pH.

In accordance with a third aspect, the invention provides a method of cleaning equipment used to circulate food products, in place, comprising:

(1) providing a cleaning solution according to the first aspect of the invention; and (2) circulating the liquid cleaning formulation through the equipment to be cleaned at a temperature of 20° C. or higher, and preferably at 40° C. or higher.

DETAILED DESCRIPTION OF THE PREFERRED EMBODIMENTS

When the term "comprising" is used herein, it shall be construed to mean "including but not limited to." The term "consisting essentially of" shall be construed to mean "including the listed components or ingredients and such additional components and ingredients which do not materially alter the basic and novel characteristics of the present cleaning solution and particulate formulation". For the sake of clarity, the basic and novel characteristics of the present solution and particulate formulation are the cleaning, stability and low-foaming characteristics for a given concentration of components or ingredients. For the sake of clarity, the term "consisting essentially of" shall be construed to include the listed components or ingredients, plus optional buffers (e.g. caustic salts such as sodium hydroxide, potassium hydroxide, or ammonium hydroxide) to provide a cleaning solution having a pH value in the specified ranges, inert fillers and diluents (e.g. sulfate salts, phosphate salts, silicate salts, carbonate salts, and mixtures thereof), corrosion inhibitors to prevent corrosion of certain metal substrates, and small or trace amounts of other ingredients commonly or typically present in commercially available components or ingredients of the present inventive solution and particulate formulation.

The term "builder" is used herein to refer to those ingredients in a cleaning solution that, through complexation, (i) eliminate alkaline-earth ions from water, substrate or soils, and (ii) support detergent cleaning action by modifying the electrostatic properties of soils, substrates and wash liquor to enhance the detergency process, prevent soil redeposition, facilitate surfactant action, and influence solution foaming properties. Examples include sequestering agents such as sodium diphosphate, sodium triphosphate, 1-hydroxyethane-1,1-diphosphonic acid, diethylenetriaminepenta (methylene phosphonic acid), nitrilotrimethylene phosphonic acid, nitrilotriacetic acid, ethylenediaminetetraacetic acid, citric acid and glycolic acid.

Without being limited by any theory herein, it is believed that several mechanisms are responsible for the cleaning performance of the solution. First, hydrogen peroxide oxidizes protein, carbohydrate and lipid molecules and destroys sulfhydryl and double bonds to break the molecules down into smaller units.

Second, builders, including cation sequestering agents (i.e. chelating agents), are believed to play an important role in the emulsification and break-up of soil particles. The builders are relied upon for enhancing detergency by (i) increasing the negative zeta potentials between soil aggregates and substrates, thereby creating an electrostatic repulsive force, and (ii) breaking down soil aggregates which are linked together by mutual cation bridges. Furthermore, chelating agents sequester dissolved cations, thereby minimizing the decomposition rate of the hydrogen peroxide in solution.

Third, the alkaline conditions are believed to have the following effects. The rate of reaction of the hydrogen peroxide with organic soils is enhanced at the pH levels of the invention. These conditions contribute to the development of a greater zeta-potential difference between substrate and soil and amongst soil particles, thereby facilitating detachment of the soil from the substrate and its emulsification in solution. Fatty acids present in many of these soils undergo saponification, thus greatly enhancing their solubility and further providing additional detergent action to, or increasing the surface activity of, the solution as a whole. Reducing the interfacial tension of the solution through surfactants results in better wetting of the soil-substrate and soil-soil interstices, thereby facilitating detachment and break-up.

Furthermore, the surfactants employed should have a high hydrotroping capacity, should produce a reduction of the interfacial tension of the wash liquor, and should not produce substantial amounts of foam. Also, they should have cloud point temperatures above the temperature at which the solutions are used. The expression "cloud point temperature" means the temperature at which a surfactant begins to become insoluble in water and a cloudy dispersion results. The invention will be better understood with reference to the following examples:

EXAMPLE 1

A liquid solution IA of the present invention was prepared as shown in Table I. The ingredients were mixed in the order shown with hydrogen peroxide being the final ingredient added. The solution pH was adjusted with caustic potash (potassium hydroxide) to a value of about 9.

TABLE I

| COMPONENT (% actives) | Solution IA % w/w | Actual Concentration % w/w |
|---|---|---|
| Deionized water | q.s. to 100 | to 100 |
| Propylene Glycol (100%) | 0.5 | 0.5 |
| Bioterge PAS-8S (38%) | 4.5 | 1.7 |
| Briquest ADPA-60AW (60%) | 7.0 | 4.2 |
| Citric Acid (100%) | 1.0 | 1.0 |
| Caustic Potash (45%) | Adjust to pH of about 9 | Adjust to pH of about 9 |
| Hydrogen Peroxide (50%) | 10.0 | 5.0 |

The solution IA of Table I includes hydrogen peroxide from a 50% aqueous technical grade commercial solution from Degussa-Hüls, Bioterge PAS-8S (trade-mark) which is a 38% active sodium octane sulfonate manufactured by Stepan, and two builders in the form of cation sequestering agents consisting of Briquest ADPA-60AW (trade-mark) which is a 60% active 1-hydroxyethylidene-1,1,-diphosphonic acid manufactured by Allbright and Wilson, and citric acid. The solution also includes deionized water as the solvent and a short chain polyhydric alcohol consisting of propylene glycol for inhibiting corrosion of metal substrates upon drying of the solution.

The cleaning performance of the solution was evaluated by measuring the mass of soil removed from aged soiled panels carefully prepared in the laboratory. Between 10 to 15 milligrams of dried milk was deposited on each 2"×2" glass slide. A plurality of the soiled glass slides were immersed in the solution for a period of 5 minutes without any mechanical action. Experiments were run at two different solution temperatures, 20° C. and 45° C. After immersion for the desired contact time, the slides were rinsed with tap water (200 ppm hardness as $CaCO_3$) and allowed to dry for several minutes before being weighed. A cleaning efficiency was defined as:

$$C.E.=(M_i-M_f)\times 100/M,$$

where $M_i$ is the initial mass of deposited soil, and $M_f$ is the mass of soil remaining after immersion in the detergent for the specified time period. A commercial detergent solution (Example IB), commonly known by its trademark, Metriclean 2, sold by Metrex Research Corporation, and based on enzymes, was utilized for comparison. The results are included in Table I-1. Example IA was diluted in water of 200 ppm hardness as $CaCO_3$ in the ratio 1:70, while the commercial enzymatic detergent solution IB was used in its recommended dilution rate of 1:140. It is clear that example IA offers a considerable improvement over the commercial detergent solution in dissolving lipids and proteins, particularly at an ambient temperature of 20° C.

TABLE I-1

| | Example 1A | | Example 1B | |
|---|---|---|---|---|
| | 20° C. | 45° C. | 20° C. | 45° C. |
| C.E. [%] | 97 ± 2 | 98 ± 2 | 32 ± 1 | 72 ± 3 |

EXAMPLE II

A more concentrated solution IIA summarized in Table II below may be made for use at higher dilution ratios with the added benefit of the solution exhibiting bactericidal properties. Again, solution IIA was formed by mixing the listed ingredients in the order in which they appear in Table II.

TABLE II

| COMPONENT (% actives) | Solution IIA % w/w | Actual Concentration % w/w |
|---|---|---|
| Deionized water | q.s. to 100 | 9.5 to 100 |
| Bioterge PAS-8S (38%) | 4.5 | 1.7 |
| Briquest ADPA-60AW | 7.0 | 4.2 |
| (60%) | 1.0 | 1.0 |
| Citric Acid (100%) | Adjust to pH = 9 | Adjust to pH = 9 |
| Caustic Potash (45%) | 14.0 | |
| Hydrogen Peroxide (50%) | | |

Solution IIA was diluted in the ratio 1:140 and exhibited similar cleaning efficiency values as compared to the values exhibited by a commercial hypochlorite-based cleaner IIB (at its recommended dilution of 1:512), as seen from the experimental results in Table II-1 below.

TABLE II-1

| | Solution IIA | | Hypochlorite cleaner IIB | |
|---|---|---|---|---|
| | 45° C. | 60° C. | 45° C. | 60° C. |
| C.E. [%] | 86 ± 11 | 98 ± 1 | 76 ± 10 | 71 ± 7 |

The higher temperatures in these experiments are more typical of applications in the food and dairy industry, where pipelines and storage tanks are cleaned and sanitized regularly with a detergent solution circulated throughout liquid carrying pipes thereof at elevated temperatures of above 20° C. Moreover, at the dilution ratio of 1:140, solution IIA is quite effective in reducing the viable counts of vegetative bacteria. Reduction in the viable counts of *Staphylococcus aureus* greater than 99.99% were observed in a suspension of organisms of $1.85\times10^6$ organisms per ml, at a contact time of 5 minutes, and a temperature of 54° C.

EXAMPLE III

Solutions IIIA, IIIB, and IIIC were prepared and summarized in Table III. Solutions IIIA, IIIB, and IIIC were prepared by adding the listed components or ingredients directly to wash water (i.e. regular tap water having a 200 ppm/as CaCo3 hardness. The pH of the solutions was the natural pH of the solutions. No buffer was added.

Solution IIIA is in accordance with the present invention. Solutions IIIB and IIIC are outside of the scope of the present invention and tested to show the contribution of the individual components, namely the hydrogen peroxide supplied by a source in the form of sodium percarbonate, and a cation sequestering agent in the form of sodium tripolyphosphate. As can be seen in Table III, the hydrogen peroxide and sodium tripolyphosphate each possess cleaning properties. However, the combination of hydrogen peroxide, sodium tripolyphosphate, and the specified anionic surfactant (38% w/w sodium octyl sulfonate) results in an unexpected and improved cleaning performance.

TABLE III

| Component (% active) | Solution IIIA % w/w | Actual Concentration % w/w (IIA) | Solution IIIB % w/w | Actual Concentration % w/w (IIIB) | Solution IIIC % w/w | Actual Concentration % w/w (IIIC) |
|---|---|---|---|---|---|---|
| Sodium Percarbonate ($Na_2CO_3.1.5H_2O_2$) (100%) | 0.13 | 0.042 | — | — | 0.13 | 0.042 |
| Sodium Tripolyphosphate (100%) | 0.06 | 0.06 | 0.06 | 0.06 | — | — |
| Bioterge PAS-8S (38%) | 0.03 | .007 | — | — | — | — |
| Water | q.s. to 100 | q.s. to 100 | q.s. to 100 | q.s. to 100 | q.s. to 100 | q.s. to 100 |
| Resulting solution pH | 10.4 | 10.4 | 8.9 | 8.9 | 10.4 | 10.4 |
| Cleaning Efficacy at 45° C. | 96.6 | 96.6 | 58.8 | 58.5 | 66.8 | 66.8 |

As 0.33 gr of hydrogen peroxide is liberated per gram of sodium percarbonate, solutions IIIA and IIIC contain hydrogen peroxide at a concentration of about 0.042% w/w.

While solution IIIA was prepared by adding each component directly to the wash water, in practice, a dry particulate formulation could be prepared containing the above components in dry form. This dry particulate formulation could then be dissolved at the appropriate dilution rate (e.g. 1 oz/4–6 gallons, or 10 mg/5–7.5 liters) to obtain solution IIIA.

EXAMPLE IV

The foaming characteristics of solution IA, IIA, and IIIA in accordance with the invention were tested. They all exhibited an instantaneous foam height of less than 6 ml after 30 inversions on a stoppered standard 250 ml graduated cylinder. In the tests, foam dissipation occurred within a period of 5 seconds or less after termination of the inversion cycle. Thus, solutions according to the present invention were found to be low-foaming.

EXAMPLE V

All of the above solutions IA, IIA, and IIIA according to this invention were subjected to accelerated stability testing as described by Steiner in U.S. Pat. No. 5,736,497. Samples of each solution were subjected to a temperature of 96° C. for a period of 16 hours to simulate storage at 20° C. for one year. In all cases, the peroxide loss was less than 50%, which is generally accepted as good in this extreme temperature test.

EXAMPLE VI

Solutions VIA and VIB according to the invention were formulated as shown in Table VI below.

TABLE VI

| Raw Material % w/w | Solution VIA % w/w | Actual concentration % w/w (VIA) | Solution VIB % w/w | Actual concentration % w/w (VIB) |
|---|---|---|---|---|
| DI water | 62.35 | 62.35 | 49.66 | 49.66 |
| Propylene Glycol (100%) | 0.50 | 0.83 | 0.50 | 0.83 |
| Briquest ADPA 60AW (60%) 1-hydroxyethylidene-1,1,-diphosphonic acid | 8.40 | 5.04 | 14.00 | 8.4 |
| Citric acid (100%) | 1.20 | 1.20 | 2.00 | 2.00 |
| Stepanate SXS (40% sodium xylene sulfonate) | 7.98 | 3.19 | — | — |
| Bioterge PAS-8S (45% sodium octyl sulfonate) | 2.00 | 0.90 | 6.00 | 2.70 |
| Pluronic 17R2 (PO-E0-PO block copolymer) (100%) | 0.48 | 0.48 | — | — |
| Caustic Potash (45% KOH) | 12.50 | 5.63 | 21.29 | 9.58 |
| Cobratec 35-G (35% 1,2,3-Benzotriazole + 65% Propylene Glycol) | 0.50 | 0.18 1,2,3-Benzotriazole | 0.50 | 0.18 1,2,3-Benzotriazole |
| Sodium Nitrite (100%) | 0.05 | 0.05 | 0.05 | 0.05 |
| H2O2 (50%) | 4.00 | 2.00 | 6.00 | 3.00 |
| pH | 9.2 | 9.2 | 9.0 | 9.0 |
| Avox loss | 0.19 | 0.19 | 0.77 | 0.77 |

The solutions were formulated by adding the listed ingredients in the order in which they appear in the table. The pH of the solution was achieved by the addition of caustic potash at the above specified levels. Pluronic 17R2 (trademark) is a polyoxyethylene/polyoxypropylene block copolymers having a polyoxypropylene molecular weight of from about 1700, of which 20% of the total molecular weight is due to the polyoxyethylene portion.

The storage stability of solutions of VIA and VIB according to the present invention was evaluated by subjecting the solutions to an accelerated stability test at 50° C. for a period of 24 hours as described by U.S. Pat. No. 4,525,291 to Smith et al. That is, a small sample of each of the solutions was transferred to a clean plastic bottle housed in a constant temperature enclosure at 50° C. The available oxygen concentrations (Avox) in the solutions, measured before and after storage for a given period, was determined by testing small samples of the solutions using the standard acidified potassium permanganate titration method. The stability of the solutions was evaluated by assessing the ability of the solutions to maintain their homogeneity and by measuring the hydrogen peroxide (or available oxygen (Avox)) loss. Solutions VIA and VIB showed hydrogen peroxide losses of less than 1% of the original content, and remained homogeneous and clear after the test period.

EXAMPLE VII

Solution VIB was tested on organic soils typically encountered in medical and dental practices. Commercially available coupons sold in association with the trademark TOSI® (sold by SteriTec Products Inc., Colorado, U.S.A.) were soiled with standard organic soils used for evaluating the efficiency of cleaners. The coupons consisted of stainless steel strips on which blood and fibrinogen-based soils were deposited and dried. The soiled coupons were then introduced in an ultrasound tank containing solution VIB diluted at the rate of 1:115, and afterwards inspected visually for any remaining debris. The coupons were completely clear after 3 minutes of processing in the tank at a temperature of 35° C., indicating satisfactory performance for the cleaning of soiled medical, dental and veterinary surgical instruments. No foam developed in the ultrasonic tank during the performance of the test.

EXAMPLE VIII

Another cleaning experiment was performed with solution VIA. Dental instruments (two dental scalpers, two dental spatulas and two hemostats) were soiled by applying a solution having 10% w/w defibrinated sheep blood in deionized water, based on the total weight of the sheep blood solution. The solution was dried on the instruments for a period of 6 hours. The instruments were placed in a stainless steel basket and placed in a Hydrim™ instrument cleaning machine (sold by SciCan, Toronto, Canada). Tests were run with solution VIA, no detergent, and a highly alkaline (pH 12), phosphate-based commercial detergent sold in association with the trademark Neodisher FT™ by Chemische Fabrik DR WEIGERT of Hamburg, Germany. The machine was programmed to dispense the cleaning solution at a dilution rate of 1:50, and the cleaning cycle was effected at a temperature of approximately 55° C. for a period of 3 minutes. After the wash cycle, the instruments were individually brushed in phosphate-buffered saline with the purpose of eluting the remains of blood for detection using a Hemastix™ strip (sold by Bayer AG of Leverkusen, Germany). This strip can detect blood concentrations as low as 1 ppm. No blood was detected by the Hemastix™ strips after one wash cycle with solution VIA, while all strips tested positive for the presence of blood in both the no detergent and Neodisher FT™ test runs.

The invention is susceptible to modification and it shall be understood that specific embodiments have been described above by way of example only. These examples shall not be construed to limit the scope of the invention as defined in the following claims.

What is claimed is:

1. An alkaline low-foaming cleaning solution for the removal of organic soils from hard surfaces and consisting essentially of:

(i) hydrogen peroxide in a concentration of from about 0.005% to about 50% w/w, based on the total weight of the solution;

(ii) at least one cation sequestering agent in a concentration of from about 0.01% to about 50% w/w, based on the total weight of the solution;

(iii) at least one anionic surfactant selected from the group consisting of short chain ($C_3$–$C_8$) alkane sulfonates and short chain (less than $C_5$) alkylarenesulfonates, in a concentration of from about 0.005% to about 40% w/w, based on the total weight of the solution; and (iv) at least one diluent selected from the group consisting of deionized water, water, and mixtures thereof, to 100% w/w.

2. A cleaning solution according to claim 1 wherein said hydrogen peroxide is supplied by a source of hydrogen peroxide selected from the group consisting of sodium percarbonate, sodium perborate monohydrate, and sodium perborate tetrahydrate, and mixtures thereof.

3. A cleaning solution according to claim 1 wherein the pH is from about 9 to about 11.5.

4. A cleaning solution according to claim 1 wherein said at least one surfactant is selected from the group consisting of alkali metal and ammonium salts of octane sulfonic acid, alkali metal and ammonium salts of cumene, toluene, and xylene sulfonic acids, and mixtures thereof.

5. A cleaning solution according to claim 1 wherein said cation sequestering agent is selected from the group consisting of citric acid, glycolic acid, polyphosphates obtained by the thermal treatment of monosodium phosphate, amino phosphonic acid compounds with 1 to 5 phosphonic acid moieties, amino-carboxylic acid analogues of amino phosphonic acid compounds with 1 to 5 phosphonic acid moieties, and mixtures thereof.

6. A cleaning solution according to claim 5 wherein said polyphosphates are selected from the group consisting of tetrasodium pyrophosphate, sodium tripolyphosphate, sodium tetraphosphate, sodium hexametaphosphate, and mixtures thereof.

7. A cleaning solution according to claim 5 wherein said amino phosphonic acid compounds are selected from the group consisting of amino tri(methylene phosphonic acid), 1-hydroxyethylidene-1,1,-diphosphonic acid, diethylenetriaminepenta (methylene phosphonic acid), ethylene diamine tetra(methylene phosphonic acid), and mixtures thereof.

8. A cleaning solution according to claim 5 wherein said amino-carboxylic acid analogues are selected from the group consisting of ethylenediaminetetraacetic acid, diethylenetriaminepentaacetic acid, nitrilotriacetic acid and mixtures thereof.

9. A cleaning solution according to claim 1 wherein, for every one part by weight hydrogen peroxide, there is from about 0.25 to about 4 parts by weight cation sequestering agent.

10. A cleaning solution according to claim 1 wherein hydrogen peroxide is present in a concentration of from about 1% to about 20% w/w, said cation sequestering agent is present in a concentration of from about 0.5% to about 20% w/w, and said anionic surfactant is present in a concentration of from about 0.005% to about 3% w/w, all based on the total weight of the solution.

11. A cleaning solution according to claim 10 wherein hydrogen peroxide is present in a concentration of from about 2% to about 7% w/w, said cation sequestering agent is present in a concentration of from about 0.5% to about 7% w/w, and said anionic surfactant is present in a concentration of from about 0.01% to about 2% w/w, all based on the total weight of the solution.

12. A cleaning solution according to claim 1 wherein hydrogen peroxide is present in a concentration of from about 0.005% to about 2% w/w, said cation sequestering agent is present in a concentration of from about 0.01% to about 2% w/w, and said anionic surfactant is present in a concentration of from about 0.005% to about 3% w/w, all based on the total weight of the solution.

13. A cleaning solution according to claim 12 wherein hydrogen peroxide is present in a concentration of from about 0.01% to about 1% w/w, said cation sequestering agent is present in a concentration of from about 0.01% to about 1% w/w, and said anionic surfactant is present in a concentration of from about 0.01% to about 2% w/w, all based on the total weight of the solution.

14. An alkaline low-foaming cleaning solution according to claim 1 containing at least one corrosion inhibitor in a concentration of from about 0.01% to about 5% w/w, based on the total weight of the solution.

15. A cleaning solution according to claim 14 wherein said corrosion inhibitor is selected from the group consisting of triazoles, nitrites, molybdates, benzoates, gluconates, short chain ($C_2$–$C_5$) polyhydric alcohols, and mixtures thereof.

16. A cleaning solution according to claim 15 wherein said corrosion inhibitor is selected from the group consisting of 1,2,3-Benzotriazole, sodium nitrite, sodium molybdate, propylene glycol, and mixtures thereof.

17. A cleaning solution according to claim 1 containing at least one buffer in an amount effective to achieve said alkaline pH.

18. A dry particulate cleaning formulation which can be dissolved in water, deionized water, or mixtures thereof to form a cleaning solution according to claim 1.

19. A dry particulate cleaning formulation according to claim 18 containing at least one source of hydrogen peroxide selected from the group consisting of sodium percarbonate, sodium perborate monohydrate, and sodium perborate tetrahydrate, and mixtures thereof.

20. A dry particulate cleaning formulation according to claim 19 containing from about 5% to about 30% w/w of said at least one source of hydrogen peroxide, from about 5% to about 50% w/w of at least one cation sequestering agent, and from about 2% to about 20% w/w of at least one anionic surfactant selected from the group consisting of short chain ($C_3$–$C_8$) alkane sulfonates and short chain (less than $C_5$) alkylarenesulfonates, all based on the total weight of the formulation.

21. A dry particulate cleaning formulation according to claim 20 wherein said at least one source of hydrogen peroxide is present in an amount of from about 15% to about 25% w/w, said cation sequestering agent is present in an amount of from about 10% to about 20% w/w, and said at least one anionic surfactant is present in an amount of from about 2% to about 10% w/w, all based on the total weight of the formulation.

22. A dry particulate cleaning formulation according to claim 18 containing an inert filler selected from the group consisting of sulfate salts, phosphate salts, silicate salts, carbonate salts, and mixtures thereof.

23. A method of cleaning equipment used to circulate food products, in place, comprising:

(1) providing a cleaning solution according to claim 13; and (2) circulating said cleaning solution through equipment to be cleaned at a temperature of 20° C. or higher.

24. A low-foaming cleaning solution having a pH of from about 8 to about 11.5 and consisting essentially of:

a) at least one surfactant selected from the group consisting of $C_3$–$C_8$ alkane sulfonates, $C_3$–$C_8$ alkyl sulfates, $C_1$–$C_7$ alkyl naphthalene sulfonates, polyoxyethylene/polyoxypropylene block copolymers having a polyoxypropylene molecular weight of from about 1500 to about 8500, of which less than about 30% of the total molecular weight is due to the polyoxyethylene portion, and mixtures thereof, in a concentration of from about 0.005% to about 40% w/w of the total solution;

b) at least one active oxygen releasing compound selected from the group consisting of hydrogen peroxide, at least one source of hydrogen peroxide, and mixtures thereof, in an amount effective to produce a hydrogen peroxide concentration of from about 0.005% to about 50% w/w of the total solution;

c) at least one builder in a concentration of from about 0.001% to about 50% w/w of the total solution; and d) at least one diluent selected from the group consisting of water, deionized water, and mixtures thereof, to 100% w/w.

25. A cleaning solution according to claim 24 wherein said source of hydrogen peroxide is selected from the group consisting of percarbonate, persilicate, persulphate, perborate, peroxyacids, dialkyl peroxides, diacyl peroxides, preformed percarboxylic acids, organic peroxides, inorganic peroxides, hydroperoxides, and mixtures thereof.

26. A cleaning solution according to claim 24 wherein said surfactant is present in a concentration of from about 0.005% to about 4% w/w, said at least one active oxygen releasing compound is present in an amount effective to produce a hydrogen peroxide concentration of from about 0.005% to about 3% w/w, and said at least one builder is present in a concentration of from about 0.001% to about 11% w/w, all based on the total weight of the solution.

27. A cleaning solution according to claim 26 wherein said at least one surfactant is present in a concentration of from about 1.5% to about 4% w/w, said at least one active oxygen releasing compound is present in an amount effective to produce a hydrogen peroxide concentration of from about 2% to about 3% w/w, and said at least one builder is present in a concentration of from about 6% to about 11% w/w, all based on the total weight of the solution.

28. A cleaning solution according to claim 26 wherein said at least one surfactant is present in a concentration of from about 0.005% to about 0.03% w/w, said at least one active oxygen releasing compound is present in an amount effective to produce a hydrogen peroxide concentration of from about 0.005% to about 0.03% w/w, and said at least one builder is present in a concentration of from about 0.001% to about 0.10% w/w, all based on the total weight of the solution.

29. A cleaning solution according to claim 24 wherein, for every one part by weight of hydrogen peroxide produced by said at least one active oxygen releasing compound, there is from about 0.25 to about 4 parts by weight of said at least one builder.

30. A cleaning solution according to claim 25 wherein said at least one source of hydrogen peroxide is selected from the group consisting of sodium percarbonate, sodium perborate monohydrate, sodium perborate tetrahydrate, and mixtures thereof.

31. A cleaning solution according to claim 24 wherein the pH is from about 8 to about 9.5.

32. A cleaning solution according to claim 24 wherein said at least one surfactant is selected from the group consisting of alkali metal and ammonium salts of octane sulfonic acid, and alkali metal and ammonium salts of cumene, toluene, xylene sulfonic acids, and mixtures thereof.

33. A cleaning solution according to claim 24 herein said at least one surfactant is selected from the group consisting of sodium octyl sulfonate, sodium xylene sulfonate, a block copolymer consisting of a polyoxyethylene block capped at both ends by polyoxypropylene blocks where the total molecular weight of the polyoxypropylene portion is 1700 and the polyoxyethylene portion comprises about 20% of the total molecular weight, and mixtures thereof.

34. A cleaning solution according to claim 24 wherein said at least one surfactant is selected from the group consisting of $C_3$–$C_8$ alkane sulfonates, $C_3$–$C_8$ alkyl sulfates, $C_1$–$C_7$ alkyl naphthalene sulfonates, and mixtures thereof.

35. A cleaning solution according to claim 24 wherein said at least one builder is a cation sequestering agent selected from the group consisting of citric acid, glycolic acid, polyphosphates obtained by the thermal treatment of monosodium phosphate, amino phosphonic acid compounds with 1 to 5 phosphonic acid moieties, amino-carboxylic acid analogues of amino phosphonic acid compounds with 1 to 5 phosphonic acid moieties, and mixtures thereof.

36. A cleaning solution according to claim 35 wherein said polyphosphates are selected from the group consisting of tetrasodium pyrophosphate, sodium tripolyphosphate, sodium tetraphosphate, sodium hexametaphosphate, and mixtures thereof.

37. A cleaning solution according to claim 35 wherein said amino phosphonic acid compounds are selected from the group consisting of amino tri(methylene phosphonic acid), 1-hydroxyethylidene-1,1,-diphosphonic acid, diethylenetriaminepenta (methylene phosphonic acid), ethylene diamine tetra(methylene phosphonic acid), and mixtures thereof.

38. A cleaning solution according to claim 35 wherein said amino-carboxylic acid analogues are selected from the group consisting of ethylenediaminetetraacetic acid, diethylenetriaminepentaacetic acid, nitrilotriacetic acid, and mixtures thereof.

39. A cleaning solution according to claim 24 containing at least one corrosion inhibitor for inhibiting corrosion of metallic substrates upon drying, in a concentration of from about 0.005% to about 5% w/w of the total solution, said at least one corrosion inhibitor being selected from the group consisting of $C_2$–$C_5$ polyhydric alcohols, triazoles, nitrites, molybdates, benzoates, gluconates, and mixtures thereof.

40. A cleaning solution according to claim 39 wherein said at least one corrosion inhibitor is selected from the group consisting of 1,2,3-benzotriazole, sodium nitrite, sodium molybdate, propylene glycol, and mixtures thereof.

41. A cleaning solution according to claim 39 wherein said at least one corrosion inhibitor is present in a concentration of from about 0.005% to about 1.5% w/w of the total solution.

42. A low-foaming cleaning solution having a pH of from about 8 to about 9.5 and consisting essentially of:

a) at least one surfactant selected from the group consisting of sodium octyl sulfonate, sodium xylene sulfonate, and a block copolymer consisting of a polyoxyethylene block capped at both ends by polyoxypropylene blocks where the total molecular weight of the polyoxypropylene portion is 1700 and the polyoxyethylene portion comprises about 20% of the total molecular weight, and mixtures thereof, in a concentration range of from about 0.005% to about 4% w/w of the total solution;

b) hydrogen peroxide in a concentration of from about 0.005% to about 3% w/w of the total solution;

c) at least one cation sequestering agent selected from the group consisting of citric acid, 1-hydroxyethylidene-1, 1,-diphosphonic acid, and mixtures thereof, in a concentration of from about 0.001% to about 11% w/w of the total solution;

d) at least one corrosion inhibitor selected from the group consisting of propylene glycol, 1,2,3-benzotriazole, sodium nitrite, sodium molybdate, propylene glycol, and mixtures thereof, in a concentration of from about 0.005% to about 1.5% w/w of the total solution; and e) at least one solvent selected from the group consisting of water, deionized water, and mixtures thereof to 100% w/w of the total solution.

43. A dry particulate cleaning formulation which can be dissolved in water, deionized water, or mixtures thereof, to produce a cleaning solution according to claim 24.

44. A dry particulate cleaning formulation according to claim 43 wherein said at least one surfactant is present in a concentration of from about 2% to about 20% w/w, said at least one active oxygen releasing compound is present in an amount to produce hydrogen peroxide in a concentration of from about 5% to about 30% w/w, and said at least one builder is present in a concentration of from about 5% to about 50% w/w, all based on the total weight of the formulation.

45. A dry particulate formulation according to claim 44 wherein said at least one surfactant is present in a concentration of from about 2% to about 10% w/w, said at least one active oxygen releasing compound is present in an amount to produce hydrogen peroxide in a concentration of from about 15% to about 25% w/w, and said at least one builder is present in a concentration of from about 10% to about 20% w/w, all based on the total weight of the formulation.

46. A dry particulate formulation according to claim 43 comprising a diluent in the form of at least one inert filler selected from the group consisting of sulfate salts, phosphate salts, silicate salts, carbonate salts, and mixtures thereof.

47. A method of cleaning equipment used to circulate food products, in place, comprising:

(1) providing a cleaning solution according to claim 28; and (2) circulating said cleaning solution through equipment to be cleaned at a temperature of 40° C. or higher.

* * * * *

UNITED STATES PATENT AND TRADEMARK OFFICE

CERTIFICATE OF CORRECTION

PATENT NO. : 6,686,324 B2
APPLICATION NO. : 10/193182
DATED : February 3, 2004
INVENTOR(S) : Ramirez et al.

It is certified that error appears in the above-identified patent and that said Letters Patent is hereby corrected as shown below:

ON THE TITLE PAGE ITEM (75) INVENTOR- PLEASE DELETE Nancy M.A. Sullivan, Toronto (CA)

Signed and Sealed this

Twenty-second Day of May, 2007

JON W. DUDAS
*Director of the United States Patent and Trademark Office*